US010813804B1

(12) United States Patent
Tu

(10) Patent No.: US 10,813,804 B1
(45) Date of Patent: Oct. 27, 2020

(54) CONVERTIBLE BED/WHEELCHAIR APPARATUS

(71) Applicant: Cong Thanh Diep Tu, Ho Chi Minh (VN)

(72) Inventor: Cong Thanh Diep Tu, Ho Chi Minh (VN)

(73) Assignee: TON DUC THANG UNIVERSITY, Ho Chi Minh (VN)

( * ) Notice: Subject to any disclaimer, the term of this patent is extended or adjusted under 35 U.S.C. 154(b) by 0 days.

(21) Appl. No.: 15/482,806

(22) Filed: Apr. 9, 2017

(51) Int. Cl.

| | |
|---|---|
| ***A61G 5/00*** | (2006.01) |
| ***A47C 17/16*** | (2006.01) |
| ***A61G 5/12*** | (2006.01) |
| ***A61G 7/018*** | (2006.01) |
| ***A61G 7/05*** | (2006.01) |

(52) U.S. Cl.
CPC ..... *A61G 5/006* (2013.01); *A47C 17/163* (2013.01); *A61G 5/125* (2016.11); *A61G 5/128* (2016.11); *A61G 7/018* (2013.01); *A61G 7/0507* (2013.01)

(58) Field of Classification Search
CPC ..... A61G 5/006; A61G 7/0507; A61G 5/125; A61G 7/018; A61G 5/128; A47C 17/163
USPC ..... 5/86.1
See application file for complete search history.

(56) References Cited

U.S. PATENT DOCUMENTS

2005/0172405 A1* 8/2005 Menkedick ..... A61B 5/1115 5/618
2007/0124858 A1* 6/2007 Ahlman ..... A61B 6/0442 5/81.1 R
2015/0342805 A1* 12/2015 Harris, Jr. ..... A61G 1/017 5/610
2017/0035633 A1* 2/2017 Amin ..... A61G 7/018

* cited by examiner

*Primary Examiner* — David E Sosnowski
*Assistant Examiner* — Myles A Throop

(57) ABSTRACT

A convertible bed/wheelchair apparatus is disclosed to include a first support frame; a second support frame; a first mattress frame segment; a second mattress frame segment; and a third mattress frame segment movably connected to one another; a first motor, a third motor, and a fourth motor operable to cause the first mattress support segment to turn into a footrest, and the second mattress frame segment to move on top of second supporting frame, and the third mattress frame segment to be erected vertically to become a head rest section of a wheelchair.

20 Claims, 5 Drawing Sheets

CONVERTIBLE BED/WHEELCHAIR APPARATUS

FIELD OF THE INVENTION

The present invention relates generally to the field of medical devices. More specifically, the present invention relates to a convertible bed into a wheelchair and vice versa.

BACKGROUND ART

In the present scenario of medical institutions, transferring of immobilized patients from bed to wheelchair and vice-versa for numerous chronic and emergency activities is a very labor intensive and tedious job.

Various attempts have been made in addressing this problem. These were modeled using simple mechanical devices providing the conversion. But still the issue of easy and controlled transition of adjusting the position of wheelchair's head and base part according to patient's needs and its full conversion has not been modeled and devised completely. So arises the need for a suitable, efficient and complete designing and development of such a device.

SUMMARY OF THE INVENTION

Accordingly, an objective of the present invention is to provide an a convertible bed/wheelchair apparatus which provides solutions to the problems described above. Thus, a convertible bed/wheelchair apparatus is disclosed to include a first support frame; a second support frame; a first mattress frame segment; a second mattress frame segment; and a third mattress frame segment movably connected to one another; a first motor, a third motor, and a fourth motor operable to cause the first mattress support segment to turn into a footrest, and the second mattress frame segment to move on top of second supporting frame, and the third mattress frame segment to be erected vertically to become a rest section of a wheelchair.

These and other advantages of the present invention will no doubt become obvious to those of ordinary skill in the art after having read the following detailed description of the preferred embodiments, which are illustrated in the various drawing Figures.

BRIEF DESCRIPTION OF THE DRAWINGS

The accompanying drawings, which are incorporated in and form a part of this specification, illustrate embodiments of the invention and, together with the description, serve to explain the principles of the invention.

DETAILED DESCRIPTION OF THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well-known methods, procedures, components, and circuits have not been described in detail so as not to unnecessarily obscure aspects of the present invention.

Figure 1:
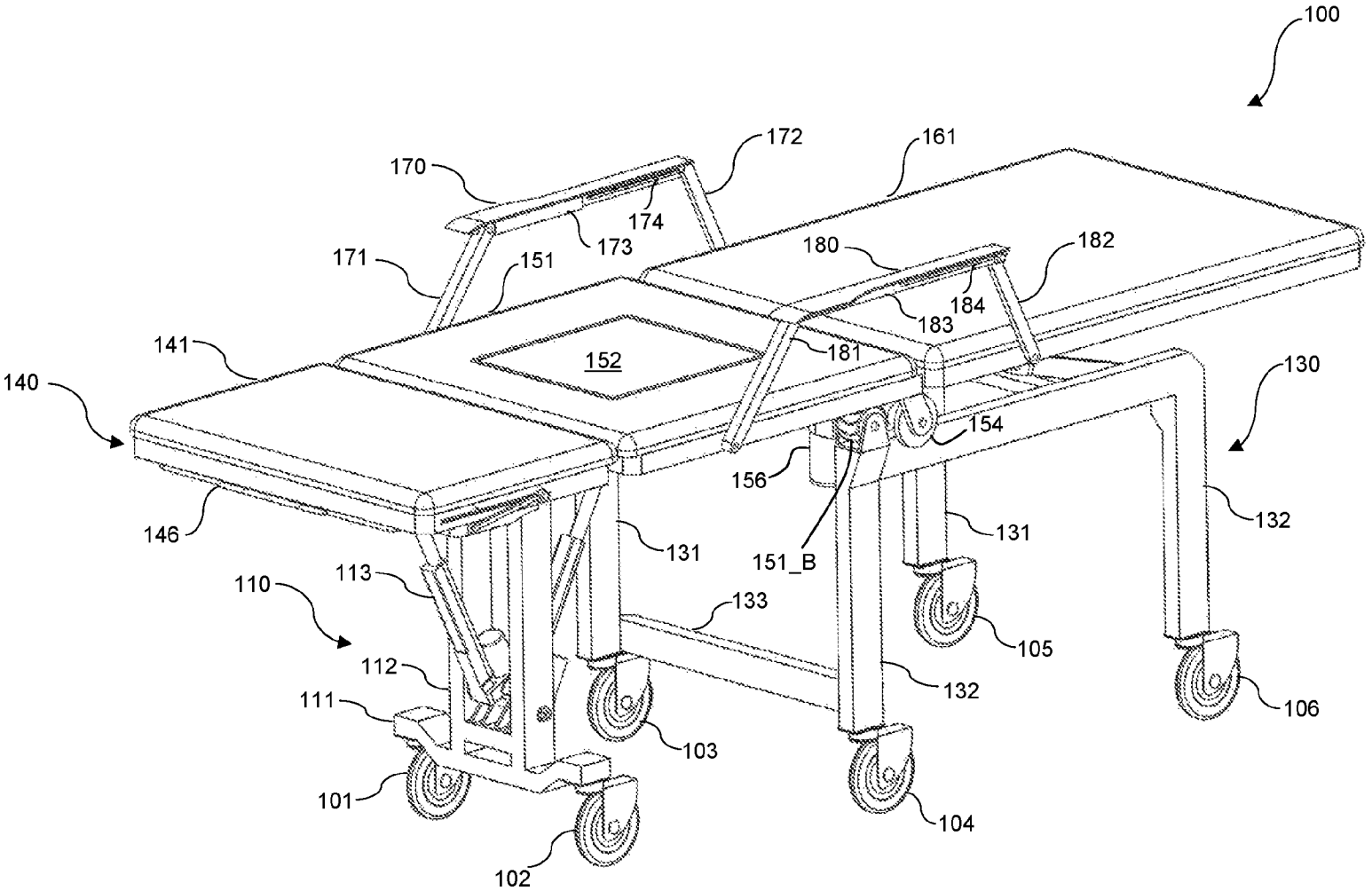
FIG. 1 illustrates a convertible bed/wheelchair apparatus in accordance with an embodiment of the present invention.

One embodiment of the invention is now described with reference to FIGS. 1 to 5. FIG. 1 shows one embodiment of a convertible bed/wheelchair apparatus 100. In the front, convertible bed/wheelchair apparatus 100 includes a first support frame 110 having a first caster wheel 101 and a second caster wheel 102. In the back, convertible bed/wheelchair apparatus 100 also includes a second support frame 130 having a third caster wheel 103, a fourth caster wheel 104, a fifth caster wheel 105, and a sixth caster wheel 106. In one embodiment, third caster wheel 103, fourth caster wheel 104, fifth caster wheel 105, and sixth caster wheel 106 are arranged from front to back at four corners of a bottom side of second support frame 130.

Continuing with FIG. 1, convertible bed/chair apparatus 100 also includes a mattress framework 140 connected to first support frame 110 and second support frame 130. Mattress framework 140 further comprising a first mattress frame segment 141, a second mattress frame segment 151, and a third mattress frame segment 161 movably connected to one another. First mattress frame segment 141 is connected directly on top of first support frame 110. Second mattress frame segment 151 is connected between first support frame 110 and second support frame 130. In one embodiment, second mattress frame segment 151 also includes an opening whereupon a lid 152 is hingedly connected. Third mattress frame segment 161 is connected directly on top of second support frame 130. In one embodiment, second mattress frame segment 151 has a first rolling wheel 153 (not seen in FIG. 1) and a second rolling wheel 154 coupled to roll back and forth along the length of the top portion of second support frame 130. On the bottom side, second mattress frame segment 151 further has a first serrated track 151_A and a second serrated track 151_B (not seen in FIG. 1). On the front of third mattress frame segment 130, right above third caster wheel 103 and fourth caster wheel 104, second supporting frame 130 is equipped with a first serrated wheel 151_C (not seen in FIG. 1) and a second serrated wheel 151_D coupled to first serrated track 151_A and second serrated track 151_B respectively.

Still referring to FIG. 1, convertible bed/wheelchair apparatus 100 also includes a first handle 170 connected to second mattress support segment 151 and third mattress support segment 161 on the left hand side and a second handle 180 connected to second mattress support segment 151 and third mattress support segment 161 on the right hand side. Specifically, first handle 170 is comprised of a first bar member 171 connected to a side of second mattress support segment 151, a second bar member 172 connected to a side of third mattress support segment 161. A first bridge member 173 connects first bar member 171 and second bar member 172. First bridge member 173 further comprises an elongated aperture 174 where second bar member 172 is coupled to slide back and forth along the length of elongated aperture 174. In the same fashion, second handle 180 further comprises a third bar member 181 connected to a side of second mattress support segment 151, a fourth bar member 182 connected to a side of third mattress support segment 161. A second bridge member 183 is designed to connects a third bar member 181 and a fourth bar member 182. Second bridge member 183 further comprises an elongated aperture 184 where fourth bar member 182 is coupled to slide back and forth along the length of elongated aperture 184. When convertible bed/wheelchair apparatus 100 is transformed into a wheelchair, first handle 170 is turned into a first arm rest by second bar member 172 being forced to glide into elongated aperture 174. Similarly, second handle 180 is also transformed into a second arm rest respectively fourth bar member 182 being forced to glide into elongated aperture 184. In one embodiment, convertible bed/wheelchair apparatus 100 has a width of 680 mm, a height of 640 mm, and a length of 1970 mm.

Figure 2:
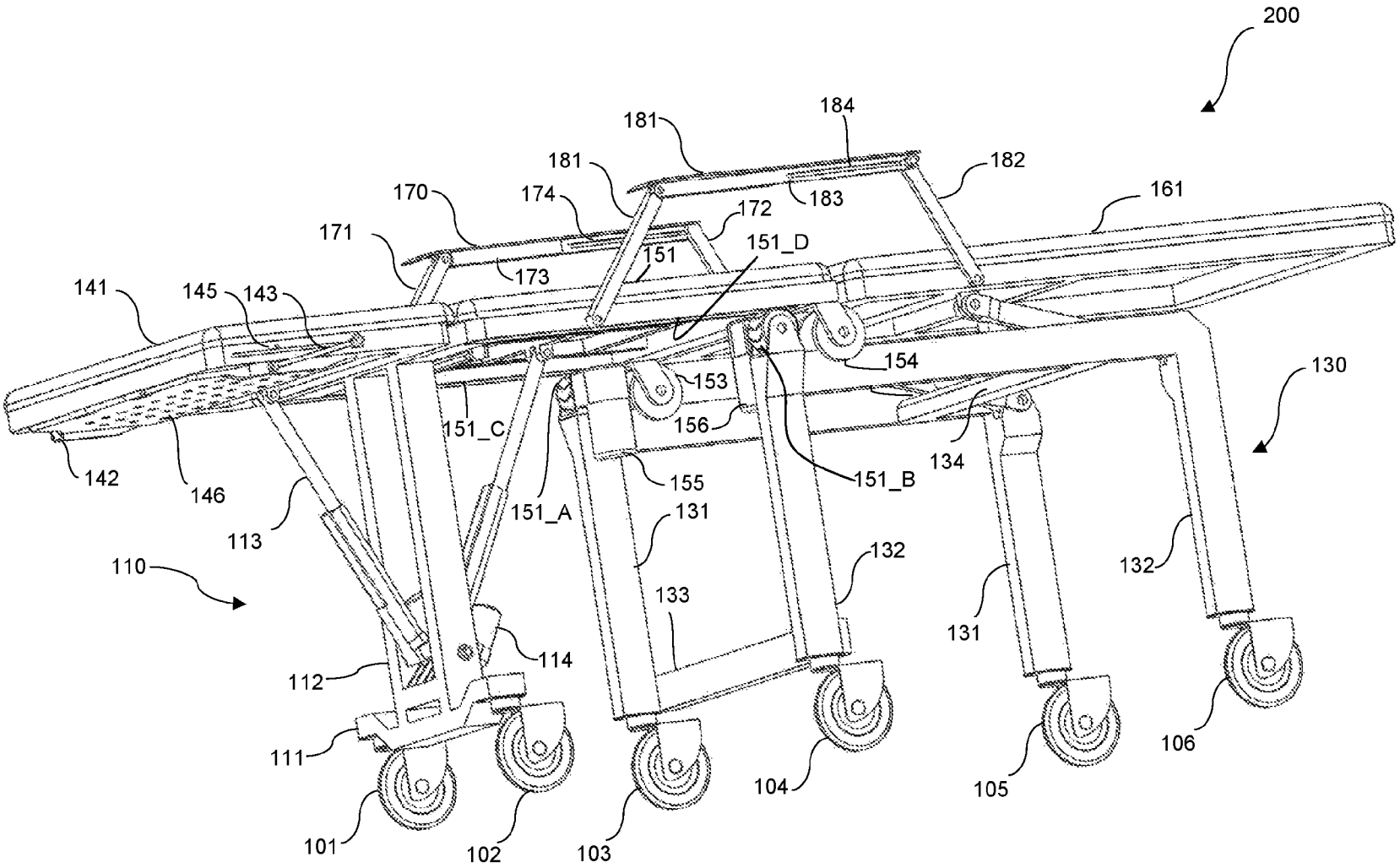
FIG. 2 is a diagram illustrating a bottom view perspective of the convertible bed/wheelchair apparatus of FIG. 1 in accordance with an embodiment of the present invention.

Next, referring to FIG. 2, a bottom view perspective 200 of convertible bed/wheelchair apparatus 100 is illustrated. As shown from the bottom of convertible bed/wheelchair apparatus 100, a planar foot rest assembly 146 is hingedly connected to the front side of first mattress support segment 141. In order to fold in and out, planar foot rest assembly 146 is connected to a first pin 142 and a second pin 143. The left hand side of planar foot rest assembly 146 is connected to first pin 142 and to a first elongated opening 144. The right hand side of rectangular footrest 146 is connected to a second pin 143 and to second elongated opening 145. This way, when planar foot rest assembly 146 is flipped out, first pin 142 glides along the length of first elongated opening 144 and second pin 143 glides along the length of second elongated opening 145.

Continuing with FIG. 2, in the preferred embodiment, first supporting frame 110 is constructed with a base 111 connected to a vertical bar 112. First caster wheel 101 and second caster wheel 102 are connected to the bottom side of base 111. Second supporting frame 130 includes a first C shaped frame 131 and a second C shaped frame 132, both inverted upside down to form a first leg, a second leg, a third leg, and a fourth leg where third caster wheel 103, fourth caster wheel 104, fifth caster wheel 105, and sixth caster wheel 106 are connected respectively. First supporting frame and second supporting frame are connected together by a first connecting bar 133 and a second connecting bar 134. First connecting bar 133 connects first C shaped frame 131 and second C shaped frame 132 at the bottom of the first leg and the second leg where third caster wheel 103 and fourth caster wheel 104 are connected. Second connecting bar 134 connects first C shaped frame 131 and second C shaped frame 132 at the top of third leg and fourth leg where the fifth caster wheel 105 and the sixth caster wheel 105 are connected. As such, first connecting bar 133 is positioned diagonally opposite to second connecting bar 134.

Still referring to FIG. 2, convertible bed/wheelchair apparatus 100 has four motors. A first motor 113 is connected between base 111 of first supporting frame 110 and the back side of first mattress support segment 141. A third motor 155 is coupled to first serrated wheel 151_A, and a fourth motor 156 is coupled to second serrated wheel 151_B. In one embodiment, first motor 113 and second motor 114 each receives a DC 24 volts DC power, maximum current 3 amps, maximum push power of 1800 N, maximum pull power 1200 N, maximum speed of 7 mm/second, maximum length of 345 mm and minimum length of 245 mm. In one embodiment, third motor 155 and fourth motor 156, each has an output power of 6 watts, 1/36, and rotate at 125 rounds per minute.

Figure 3:
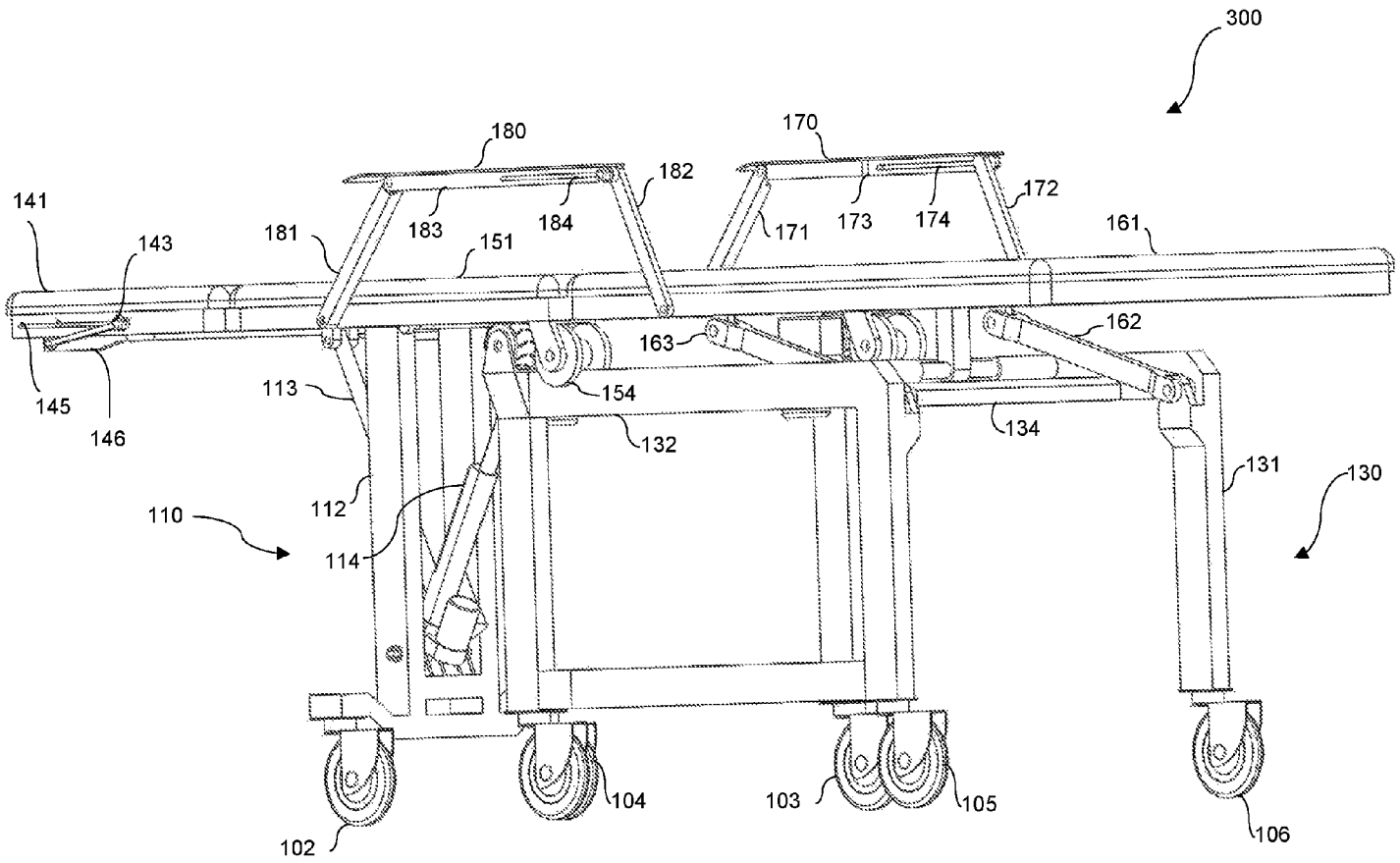
FIG. 3 is a diagram illustrating a lateral view of the convertible bed/wheelchair apparatus of FIG. 1 in accordance with an embodiment of the present invention.

Now referring to FIG. 3, a lateral view 300 of convertible bed/wheelchair apparatus 100 is illustrated. Rear view 300 shows that convertible bed/chair apparatus 100 also includes a first swinging bar 162 and a second swing bar 163. One end of first swinging bar 162 is fixedly connected to the back of second mattress support segment 151. The other end of first swing bar 162 is rotatably connected to the top of to the third leg of second C shaped frame 132. Similarly, one end of second swinging bar 163 is fixedly connected to the back of second mattress support segment 151, and the other end of second swing bar 163 is rotatably connected to the top of to the fourth leg of second C shaped frame 131.

Figure 4:
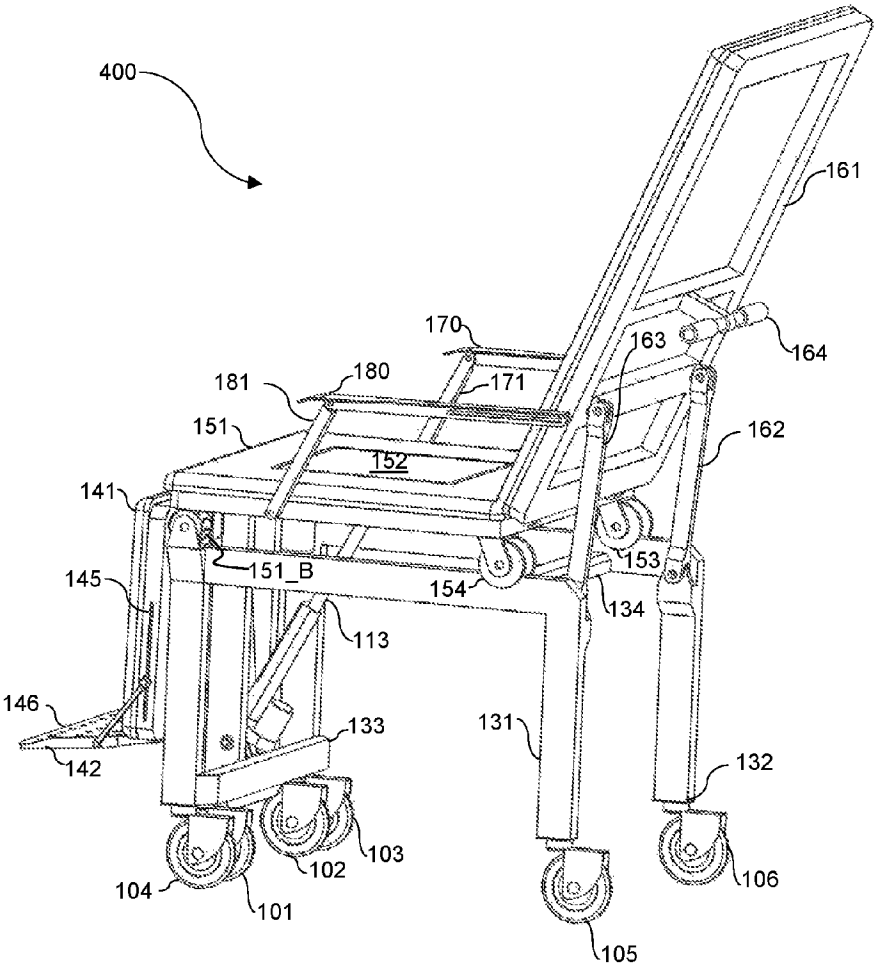
FIG. 4 is a convertible bed/wheelchair apparatus of FIG. 1 after being transformed into a wheelchair in accordance with an embodiment of the present invention.

Next referring to FIG. 4 which illustrates a diagram of a convertible bed/wheelchair 100 after being transformed into a wheelchair 400. In operation, when convertible bed/wheelchair apparatus 100 is about to be transformed into wheelchair 400, first motor 113, third motor 155, and fourth motor 156 are activate simultaneously to cause the following to happen:

(1) First mattress support segment 141 is folded vertically down, causing first pin 142 to glide down the length of first elongated opening 144 and second pin 143 to glide down the length of second elongated opening 145; which causes planar foot rest assembly 146 to swing forward into a foot rest;

(2) First serrated wheel 151_A and second serrated wheel 154_B to rotate along first serrated track 151_C and second serrated track 151_D, causing first rolling wheel 153 and second rolling wheel 154 to roll along the length of second mattress support frame 151, bringing second mattress support segment 151 to lie directly on top and coincide with second supporting frame 130; at the same time, first supporting frame 110 rolling to merge into the front of second supporting frame 130; and (3) First swinging bar 162 and second swinging bar 164 rotating counter-clockwise from second C shaped frame 131 or upward to erect third mattress support segment 161 into the back of chair 400.

In one embodiment, wheel chair 400 has a height of 920 mm, a length from rectangular foot rest assembly 146 to the highest point of third mattress support segment 161 is 860 mm, and a width of 680 mm.

In one embodiment, convertible bed/wheelchair apparatus 100 has a T shaped handle 164 connected to the back of third mattress support segment 161.

Figure 5:
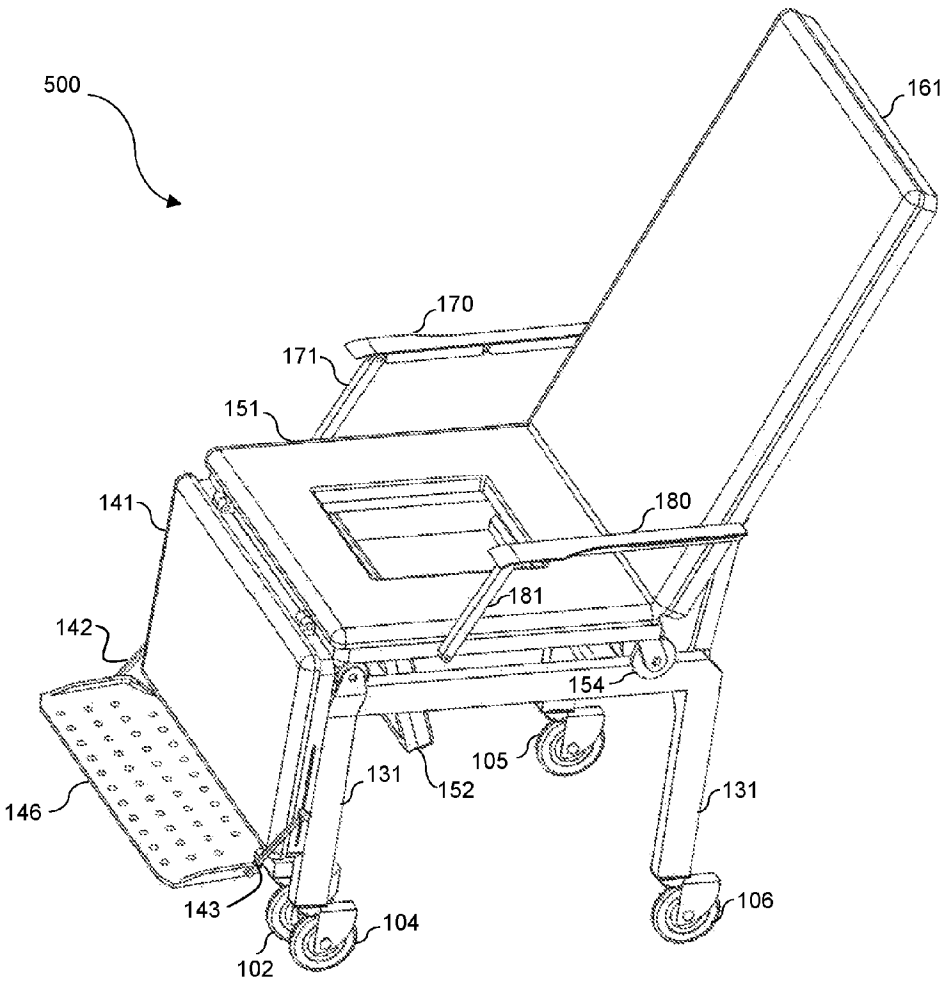
FIG. 5. is a diagram illustrating top down view of the wheelchair of FIG. 4 with a lid opened in accordance with an embodiment of the present invention.

Finally, referring to FIG. 5, a diagram 500 of a converted wheelchair with a lid opened is illustrated. When a user needs to excrete, second motor 114 is activated to draw lid 152 down. On the other hand, lid 152 is kept closed by means of second motor 114 extending out to its maximum length.

The foregoing description details certain embodiments of the invention. It will be appreciated, however, that no matter how detailed the foregoing appears in text, the invention can be practiced in many ways. As is also stated above, it should be noted that the use of particular terminology when describing certain features or aspects of the invention should not be taken to imply that the terminology is being re-defined herein to be restricted to including any specific characteristics of the features or aspects of the invention with which that terminology is associated. The scope of the invention should therefore be construed in accordance with the appended claims and any equivalents thereof.

What is claimed is:

1. A convertible bed/wheelchair apparatus, comprising:

a first support frame having a first caster wheel and a second caster wheel;

a second support frame having a third caster wheel, a fourth caster wheel, a fifth caster wheel, and a sixth caster wheel, wherein said third caster wheel, said fourth caster wheel, said fifth caster wheel, and said sixth caster wheel are arranged from front to back at four corners of a bottom side of said second support frame respectively;

a mattress framework, connected to said first support frame and said second support frame, said mattress framework further comprising a first mattress frame segment, a second mattress frame segment, and a third mattress frame segment movably connected to one another; wherein said first mattress frame segment is connected directly on top of said first support frame, said second mattress frame segment is connected between said first support frame and said second support frame, and said third mattress frame segment is connected directly on top of said second support frame;

wherein said second mattress frame segment further comprises a first rolling wheel and a second rolling wheel coupled to roll back and forth along said second support frame, wherein on the bottom side, said second mattress frame segment further comprises a first serrated track and a second serrated track;

wherein said third mattress frame segment further comprises a first serrated wheel and a second serrated wheel coupled to said first serrated track and said second serrated track respectively;

a first motor, coupled between the base of said first support frame and the bottom of said first mattress frame segment;

a third motor coupled to said first serrated wheel operable to cause said first serrated wheel to move along the length of said first serrated track;

a fourth motor coupled to said second serrated wheel operable to cause said second serrated wheel to move along the length of said second serrated track;

a first rotating arm with a first side that is fixedly coupled to the bottom of said third mattress frame segment and a second side that is rotably connected to said second support frame; and a second rotating arm with a first side that is fixedly coupled to the bottom of said third mattress frame segment and a second side that is rotably connected to said second support frame;

wherein said first motor, said third motor, and said fourth motor operate simultaneously to cause:

said first serrated wheel and said second serrated wheel to move said second mattress frame segment to lie completely on top of said second support frame;

said first rotating arm, said second rotating arm to rotate upward into a vertical position in order to vertically bring said third mattress frame segment into the back of a wheelchair; and said first mattress frame segment to fold down and said first support frame to move toward and merge into said second support frame.

2. The convertible bed/wheelchair apparatus of claim 1 wherein said first mattress frame segment further comprises:

a planar foot rest assembly hingedly coupled to the front side of said first mattress frame segment;

a first elongated aperture located along the left hand side of said first mattress frame segment;

a first pin, coupled to said first elongated aperture and connected to said planar foot rest assembly;

a second elongated aperture located along the right hand side of said first mattress frame segment;

a second pin, coupled to said second elongated aperture and connected to said planar foot rest assembly.

3. The convertible bed/wheelchair apparatus of claim 1 wherein when said first motor, a second motor, and said third motor, and said fourth motor operate simultaneously to convert said convertible bed into a wheelchair further comprises:

a planar foot rest assembly is opened as said first mattress frame segment is folding down causing a first pin and a second pin to slide along a first elongated aperture and a second elongated aperture respectively.

4. The convertible bed/wheelchair apparatus of claim 3 wherein said first motor and said second motor each receives a DC 24 volts DC power, maximum current 3 amps, maximum push power of 1800 N, maximum pull power 1200 N, maximum speed of 7 mm/second, maximum length of 345 mm and minimum length of 245 mm.

5. The convertible bed/wheelchair apparatus of claim 1 wherein said second mattress support frame segment further comprises:

an opening located at the center of said second mattress support frame segment;

a lid;

a second motor, connected at the base of said first support frame and the bottom of said lid, operable to open or close said lid.

6. The convertible bed/wheelchair apparatus of claim 1 further comprising:

a first handle connected to said second mattress frame segment and said third mattress frame segment on the left hand side;

a second handle connected to said second mattress frame segment and said third mattress frame segment on the right hand side.

7. The convertible bed/wheelchair apparatus of claim 6 wherein said first handle further comprises:

a first bar member connected to said second mattress frame segment;

a second bar member connected to said third mattress frame segment;

a first bridge member that connects said first bar member and said second bar member.

8. The convertible bed/wheelchair apparatus of claim 7 wherein said first bridge member further comprises: a third elongated opening where said second bar member is coupled to slide back and forth along the length of said first elongated opening.

9. The convertible bed/wheelchair apparatus of claim 6 wherein said second handle further comprises:

a third bar member connected to said second mattress frame segment;

a fourth bar member connected to said third mattress frame segment;

a second bridge member that connects said third bar member and said fourth bar member.

10. The convertible bed/wheelchair apparatus of claim 9 wherein said second bridge member further comprises: a second elongated opening where said fourth bar member is coupled to slide back and forth along the length of said second elongated opening so that when said convertible bed/wheelchair apparatus is transformed into said wheelchair said first handle and said second handle are also transformed into a first arm rest and a second arm rest respectively.

11. The convertible bed/wheelchair apparatus of claim 10 wherein said first handle is transformed into said first arm rest by sliding said third bar member into said first elongated opening in said first bridge member.

12. The convertible bed/wheelchair apparatus of claim 10 wherein said second handle is transformed into said second arm rest by sliding said fourth bar member into said second elongated opening in said second bridge member.

13. The convertible bed/wheelchair apparatus of claim 1 wherein said third motor and said fourth motor each has an output power of 6 watts, and rotate at 125 rounds per minute.

14. The convertible bed/wheelchair apparatus of claim 1 wherein said second support frame further comprises a first rectangular C shaped frame and a second rectangular C shaped frame connected by a first connecting bar and a second connecting bar.

15. The convertible bed/wheelchair apparatus of claim 14 wherein said first connecting bar fixedly connects said first rectangular C shaped frame and said second rectangular C shaped frame near said third caster wheel and said fourth caster wheel.

16. The convertible bed/wheelchair apparatus of claim 14 wherein said second connecting bar fixedly connects said first rectangular C shape frame and said second rectangular C shape frame on the same surface with said first rolling wheel and said second rolling wheel.

17. The convertible bed/wheelchair apparatus of claim 1 wherein when converted into a bed, said convertible bed/wheelchair apparatus has a width of 680 mm, a height of 640 mm, and a length of 1970 mm.

18. The convertible bed/wheelchair apparatus of claim 1 wherein when converted into a wheel chair, said wheel chair has a height of 920 mm, a length from said foot rest assembly to the highest point of said third mattress frame segment is 860 mm, and a width of 680 mm.

19. The convertible bed/wheelchair apparatus of claim 1 wherein said second mattress frame segment has dimensions approximately equal to said second support frame so that when said convertible bed/wheelchair apparatus is transformed into said wheelchair, said second mattress frame segment is moved to lie directly on top and is equal in surface area with said second support frame.

20. The convertible bed/wheelchair apparatus of claim 1 wherein said third mattress frame segment further comprises a T shaped handle connected to the bottom side of said third mattress frame segment.

* * * * *